United States Patent [19]

Aggio

[11] Patent Number: 5,073,218

[45] Date of Patent: Dec. 17, 1991

[54] METHOD OF TRANSFERRING A TONER IMAGE TO A SUBSTRATE

[75] Inventor: Giordano Aggio, Modena, Italy

[73] Assignee: Calco Cloth S.R.L., Modena, Italy

[21] Appl. No.: 500,009

[22] Filed: Mar. 27, 1990

[30] Foreign Application Priority Data

May 12, 1989 [IT] Italy ..... 40075 A/89

[51] Int. Cl.[5] ..... B44C 1/175; B41M 5/04

[52] U.S. Cl. ..... 156/230; 101/470; 101/472

[58] Field of Search ..... 101/470, 472, 468, 487, 101/488, 492; 156/230, 236, 323

[56] References Cited

U.S. PATENT DOCUMENTS

| | | | |
|---|---|---|---|
| 153,610 | 7/1874 | Reif et al. | 156/236 |
| 220,619 | 10/1879 | Hudson et al. | 156/230 |
| 1,713,151 | 5/1929 | Terlinden | 156/230 |
| 1,820,559 | 8/1931 | Cox | 156/230 |
| 1,966,942 | 7/1934 | Atkinson | 156/230 |
| 1,968,083 | 7/1934 | Lawrence | 156/230 |
| 2,071,163 | 2/1937 | Emmey | 156/230 X |
| 2,688,579 | 9/1954 | Meyer | 156/230 |
| 2,810,976 | 10/1957 | Scott | 156/230 |
| 3,363,557 | 1/1968 | Blake | 101/470 |
| 3,639,200 | 2/1972 | Elmendorf et al. | 156/323 X |

*Primary Examiner*—Clifford D. Crowder

*Attorney, Agent, or Firm*—Laff, Whitesel, Conte & Saret

[57] ABSTRACT

The process involves photocopying a black-and-white or color image on a sheet of ordinary paper (2), appearing as the reverse of the image ultimately to be produced, then placing the copy side of the sheet in direct contact with the suface of the fabric (1) and applying pressure and heat in such a way as causes the toner, from which the copy image is constructed, to transfer to the fabric. Solvent is applied to the exposed surface of the sheet to facilitate separation of toner from the sheet.

6 Claims, 1 Drawing Sheet

METHOD OF TRANSFERRING A TONER IMAGE TO A SUBSTRATE

BACKGROUND OF THE INVENTION

The present invention relates to a printing process suitable in particular for fabrics, leathers and similar materials.

The prior art in this field, and especially the field of quality print finishing, embraces methods which by their very nature and constitution are unsuited to cost-efffective exploitation for limited and dissimilar production runs. As a general rule, in fact, the not inconsiderable cost of special print equipment needed for the particular operation (silkscreens etc.) must be spread directly over the unit cost.

To this cost must be added that of setting up the equipment, which is reflected in the time required, and the necessity of using specialized personnel. The object of the present invention is to provide a printing process, in particular for fabrics, that can be implemented easily using simple means and requires no preparation of special equipment as in the case, for example, of silkscreen processes.

SUMMARY OF THE INVENTION

The stated object is comprehensively realized in the process disclosed, which is ideally suited to short production runs and offers great flexibility of use. Briefly, the process consists in making an initial photocopy of the image in reverse, then offering the photocopy to the material, fabric, leather or whatever, sandwiching these two layers between further layers of a flexible heat-resistant cushioning material, and applying heat and pressure for a duration sufficient to melt the copy toner and thus cause the image to transfer to the surface of the fabric. This accomplished, solvents can be applied to assist full separation of the toner from the copy paper, and the transferred image will then appear; the image can also be fixed chemically, if necessary.

BRIEF DESCRIPTION OF THE DRAWINGS

The invention will now be described in detail, by way of example, with the aid of the accompanying FIG. 1, which is an exploded view illustrating the arrangement of means utilized during one step of the method.

DESCRIPTION OF THE PREFERRED EMBODIMENTS

Figure 1:
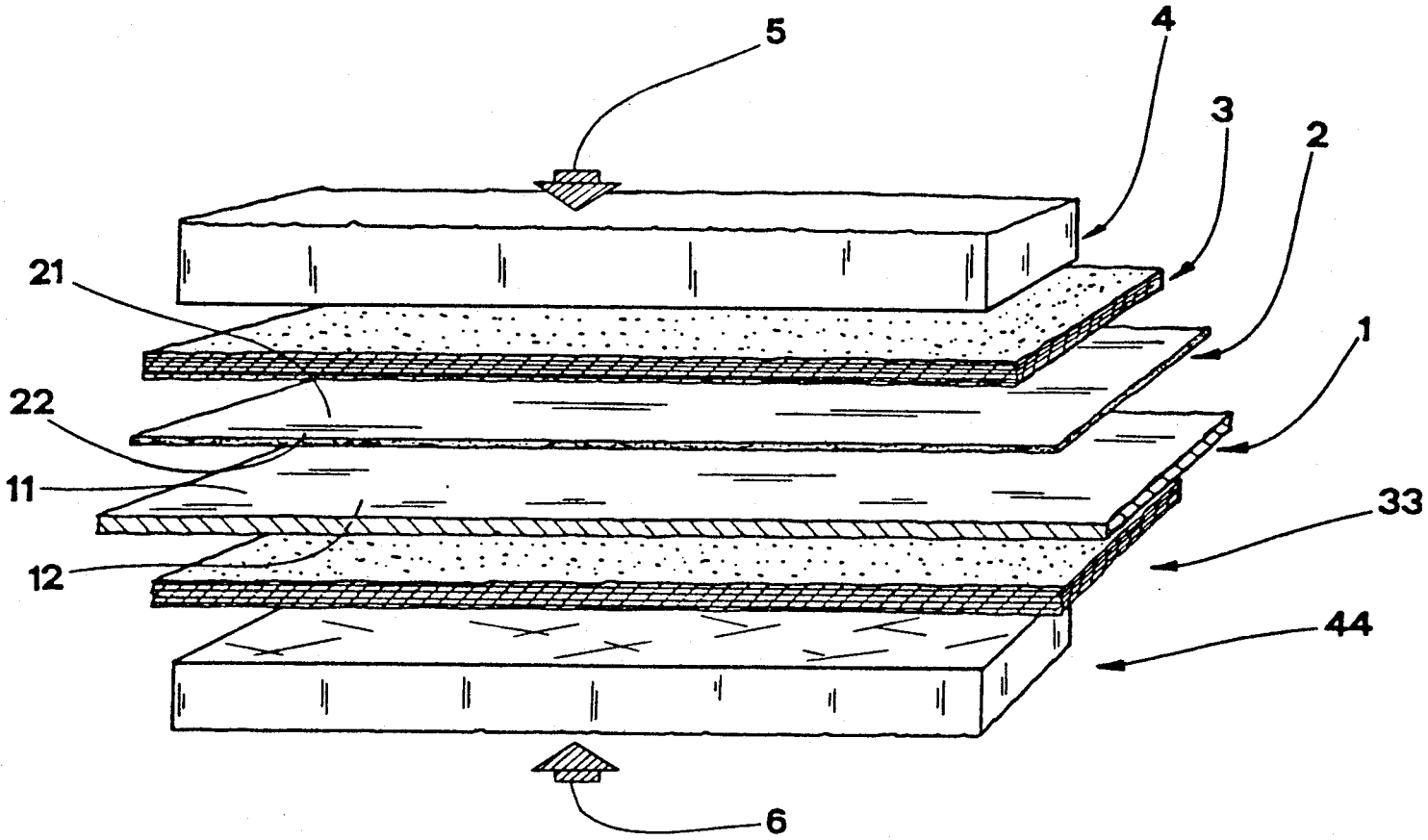

According to the invention, a black-and-white or color image is reproduced on one surface 11 of a fabric 1, or rather, printed, by transferring a previously prepared reverse image, made from copy toner or any other suitable toner solution, to a surface 22 of a sheet of. paper 2.

The monochrome or color reverse image that is made from the copy toner is produced on the surface 22 of the sheet 2 by conventional photocopying, using ordinary paper. This operation need present no problems whatever, even in the case of a color reproduction, as the state of the art now embraces machines that will photocopy in color from prints or even from transparencies.

The paper sheet 2 is positioned with the surface 22 bearing the reverse image offered in uniform and flush contact to the surface 11 of the fabric 1, and with its opposite surface 21 covered by a thin backing layer of flexible material 3, a silicone elastomer for example, of uniform thickness.

A further uniform layer of flexible material 33 is laid beneath and in flush contact with the back surface 12 of the fabric 1.

The multilayer sandwich formed in this manner is compressed hot between two parallel plates 4 and 44 operated by a conventional press (not illustrated), as indicated by the arrows 5 and 6; at least the top plate 4 will be heated and maintained for the duration of the pressing operation at a prescribed temperature, generally no higher than 200° C., but at all events such as to ensure partial fusion of the toner from which the reverse image presented by the surface 22 of the sheet 2 is constructed. The pressing force will depend on the type of fabric 1 and is tied to the temperature and duration of the press stroke, which are both variable parameters. The two flexible backing layers 3 and 33 will be fashioned from an elastically deformable material able to withstand the thermal stresses generated in pressing without undergoing change.

On completion of the pressing operation, the fused transfer sheet 2 and fabric 1 are separated from the backing layers 3 and 33, whereupon a solvent, for example a nitro based thinner such as those suitable for paints and varnishes, is applied to the exposed surface 21 of the transfer sheet 2 using light pressure in order to facilitate the separation of the toner, hence transfer of the image from the relative surface 22 of the sheet; thereafter, when the sheet 2 is lifted, the toner will be seen to have attached itself permanently to the surface 11 of the fabric 1, which thus bears the printed image.

With the transfer process complete, the printed image can be chemically fixed. The image produced in this manner is of optimum quality; moreover, the process according to the invention is characterized by great flexibility, inasmuch as it permits of reproducing any given image without the need to set up costly equipment such as dies, silkscreens etc., neither of which can generate more than one image at one time; what is more, color silkscreen processes require one screen for each of the single colors.

What is claimed:

1. A method for transferring a toner image prepared by a conventional photocopy process from a paper substrate to a substrate of fabric, leather or other material comprising the following steps:

producing a toner image on a sheet of paper (2) by conventional photocopy means;

placing the sheet of paper (2) directly over the material (1) to be printed, with the surface (22) of the sheet bearing the image directly over the surface (11) of the substrate destined to receive the image;

protecting at least one exposed surface of paper (2) and material (1) with an elastically deformable, heat resistant backing layer (3, 33) of uniform thickness;

hot-pressing the layers by application of a force directed perpendicularly to their surfaces for a given duration at a given pressure and temperature to fuse the surface (22) of the sheet bearing the image with the surface (11) of the substrate receiving the image;

separating the backing layer (3, 33) from the paper (2) and material (1);

applying solvent under gentle pressure to the exposed surface (21) of the sheet paper (2), still fused to the material (1), to the end of facilitating separation of the toner or ink from the sheet;

lifting the sheet (2) from the material (1);

fixing the printed image which appears on the material (1).

2. The method of claim 1, wherein the surface (22) of the sheet (2) bears an image that is the exact reverse of the image to be transferred to the material (1).

3. The method of claim 1, wherein two elastically deformable backing layers (3, 33) of uniform thickness are applied one to each exposed surface of the fused sheet (2) and material (1).

4. The method of claim 1, wherein the elastically deformable backing layer (3, 33) of uniform thickness is designed to withstand thermal stresses generated in hot-pressing the fused sheet (2) and material (1).

5. The method of claim 4, wherein the temperature is such as to produce at least partial fusion of the toner from which the reverse image is constructed.

6. The method of claim 1, wherein the elastically deformable backing layer (3, 3) is a silicone elastomer.

* * * * *